US007281385B2

(12) United States Patent
Wakatsuki

(10) Patent No.: US 7,281,385 B2
(45) Date of Patent: Oct. 16, 2007

(54) ICE MAKING METHOD FOR A VERTICAL ICE MAKING MACHINE

(75) Inventor: Yuji Wakatsuki, Aichi-ken (JP)

(73) Assignee: Hoshizaki Denki Kabushiki Kaisha, Aichi-ken (JP)

( * ) Notice: Subject to any disclaimer, the term of this patent is extended or adjusted under 35 U.S.C. 154(b) by 237 days.

(21) Appl. No.: 11/142,336

(22) Filed: Jun. 2, 2005

(65) Prior Publication Data

US 2006/0272339 A1 Dec. 7, 2006

(51) Int. Cl.
*F25C 1/12* (2006.01)

(52) U.S. Cl. ..... 62/74; 62/347

(58) Field of Classification Search ..... 62/73, 62/74, 347, 352
See application file for complete search history.

(56) References Cited

U.S. PATENT DOCUMENTS 3,913,349 A * 10/1975 Johnson ..... 62/352
4,366,679 A * 1/1983 Van Steenburgh, Jr. ..... 62/347
4,580,410 A * 4/1986 Toya ..... 62/347
4,727,729 A * 3/1988 Toya ..... 62/347
6,209,340 B1 * 4/2001 Lu ..... 62/347

FOREIGN PATENT DOCUMENTS

JP 3-28280 6/1991

* cited by examiner

*Primary Examiner*—William E. Tapolcai
(74) *Attorney, Agent, or Firm*—Wenderoth, Lind & Ponack, L.L.P.

(57) ABSTRACT

In an ice making plate where a plurality of ice making regions are formed in the vertical direction, a projecting portion having a lateral width B smaller than a lateral width A of the ice making regions is formed between adjacent ice making regions. At least one non-projecting portion or area is defined at least one side of the projecting portion and located between adjacent ice making regions. Most of the ice growth is restricted by an upper surface portion and a lower surface portion of the projecting portion, and the ice is thereby partially prevented from connecting to the ice formed in the adjacent ice making region. However, a part of the ice grows in the at least one non-projecting portion or area, and partially connected ice is formed by the connection of the ice formed in the non-projecting portion or area to the ice grown in the adjacent ice making region. The partially connected ice is dropped as an integrated whole from the ice making plate.

4 Claims, 9 Drawing Sheets

ICE MAKING METHOD FOR A VERTICAL ICE MAKING MACHINE

BACKGROUND OF THE INVENTION

1. Field of the Invention

The present invention relates to an ice making method for producing ice in a vertical ice making machine comprising an ice making plate extending in the vertical direction.

2. Description of the Related Art

FIG. 8 shows the vicinity of an ice making plate in a conventional vertical ice making machine as disclosed in Japanese Utility Model Examined Publication No. H3-28280. A plurality of vertical ribs 2 are formed on the surface of an ice making plate 1 so as to extend in the vertical direction. Each vertical rib 2 is arranged at regular intervals in the lateral direction of the ice making plate 1. The plurality of vertical ribs 2 regulate the lateral size of the ice produced on the surface of the ice making plate 1. Further, a plurality of projecting portions 3 for facilitating dropping the ice are provided at regular intervals in the vertical direction between the adjacent vertical ribs 2. On the other hand, a cooling tube 4 is provided at the back surface of the ice making plate 1 as an evaporator for a refrigeration circuit (not shown).

During an ice making cycle with the above ice making machine, ice making water flows from a water distributor (not shown), provided at the upper part of the ice making plate 1, onto the surface of the ice making plate 1. The ice making water is cooled by the cooling tube 4, and substantially half-roll-shaped ice nuggets 6, as indicated by the solid lines in FIG. 9, are formed on the surface portion of the ice making plate 1, which corresponds to the opposite side of the cooling tube 4. A distance $L_1$ from the cooling tube 4 to the edge face of the ice nugget 6, a pitch $P_1$ of the cooling tube 4 etc., are determined such that each ice nugget 6 does not connect to the other ice nuggets 6 formed above and below it. Thus, the ice nuggets 6 are formed at regular intervals.

During a deicing cycle, deicing water at an ordinary temperature is distributed to the back surface of the ice making plate 1 and a portion of each ice nugget 6, which is in contact with the surface of the ice making plate 1, melts slightly, whereby, as indicated by the broken line of FIG. 9, the ice nugget 6 is supposed to slide downward by its own weight so as to ride over the projecting portion 3, to separate and fall from the ice making plate 1.

However, in the vertical ice making machine described above, since the ice nuggets 6 are formed at regular intervals so that each ice nugget 6 does not connect to the other ice nuggets 6 formed above and below it, a lot of space that is not utilized for ice making is formed, and the amount of ice making per unit surface area of the ice making plate 1 is reduced. Thus, there is a problem in that a large surface area for ice making is required.

Further, in the vertical ice making machine described above, since each ice nugget 6 formed individually falls from the ice making plate 1, there is a problem in that it takes a significant amount of time to drop all the ice nuggets 6 due to variations in melting of the contact portion of each nugget 6 with the ice making plate 1. Furthermore, as a result, there is a possibility of increasing the deicing water usage and the amount of the melting ice nuggets 6.

SUMMARY OF THE INVENTION

The present invention is made to solve the conventional problems described above. It is an object of the present invention to provide an ice making method for a vertical ice making machine, which is capable of increasing the amount of ice making per unit surface area for ice making while facilitating ice dropping.

To attain the above object, according to the present invention, the ice making method for a vertical ice making machine comprising an ice making plate where a plurality of ice making regions are formed in the vertical direction, wherein ice is produced in each ice making region and the ice drops from the ice making plate, comprises:

forming partially connected ice by connecting ice produced in adjacent ice making regions to each other by producing ice in non-projecting portions between the adjacent ice making regions in the vertical direction while partially preventing the ice produced in adjacent ice making portions from connecting to each other by forming a projecting portion having a lateral width smaller than that of the ice making region between the adjacent ice making regions in the vertical direction; and dropping the partially connected ice as an integrated whole from the ice making plate.

DESCRIPTION OF THE PREFERRED EMBODIMENTS

An embodiment of the present invention will be described below with reference to the accompanying drawings.

Figure 1:
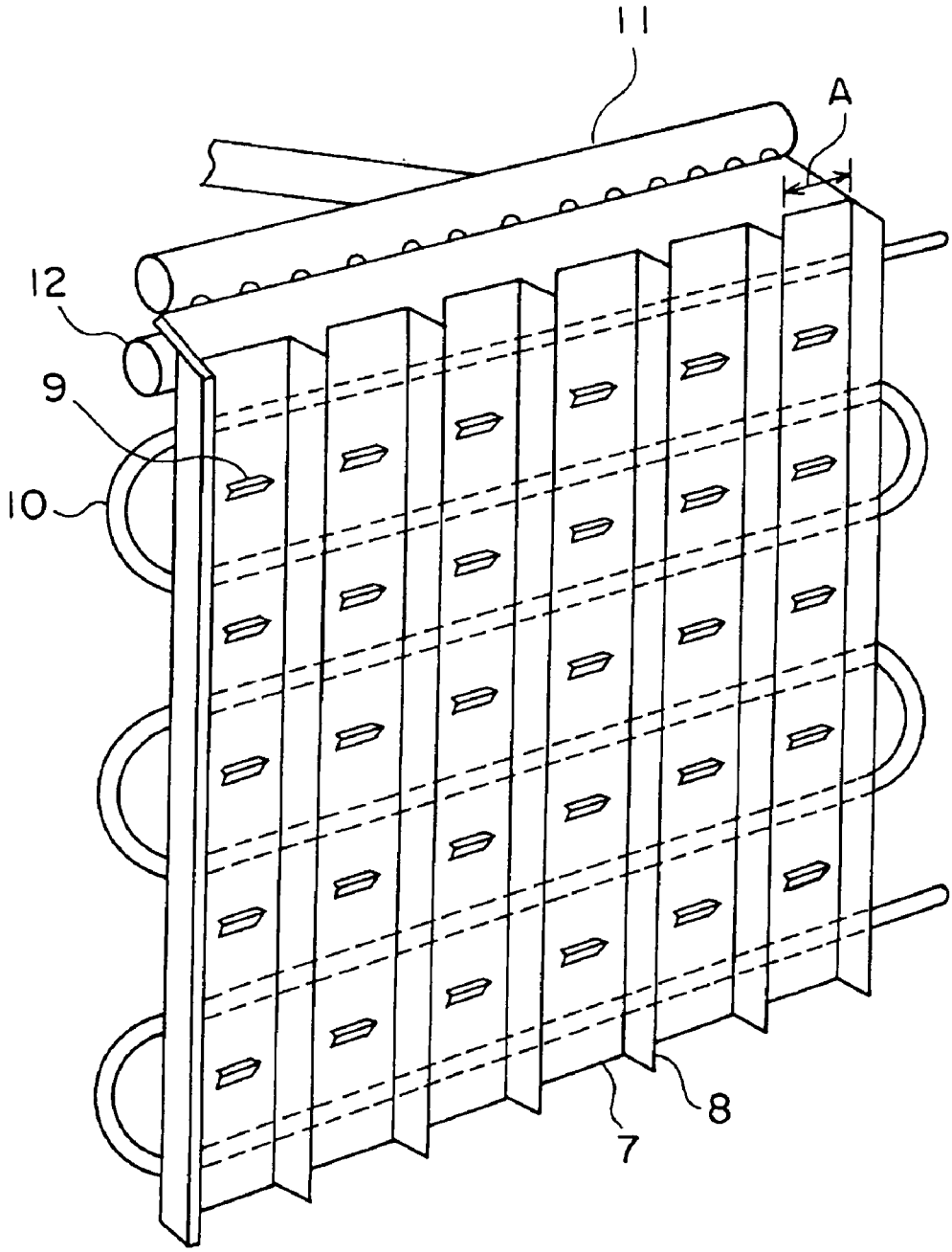
FIG. 1 is a perspective structural view showing the vicinity of an ice making plate of a vertical ice making machine for which an ice making method according to an embodiment of the present invention is implemented.

FIG. 1 shows the vicinity of an ice making plate in a vertical ice making machine for which an ice making method according to this embodiment is implemented. A plurality of vertical ribs 8 that extend in the vertical direction are formed on the surface of an ice making plate 7 provided in the vertical direction. Each vertical rib 8 is arranged at regular intervals A in the lateral direction of the ice making plate 7. The plurality of vertical ribs 8 specify the lateral size of the ice produced on the surface of the ice making plate 7. Further, a plurality of projecting portions 9 for preventing the connection of ice are provided in the vertical direction at regular intervals between the adjacent vertical ribs 8. On the other hand, a cooling tube 10 is provided at the back surface of the ice making plate 7 as an evaporator for a refrigeration circuit. Further, an ice making water distributor 11 for distributing ice making water to the surface of the ice making plate 7 and a deicing water distributor 12 for distributing deicing water to the back surface of the ice making plate 7 are provided with the upper part of the ice making plate 7.

Figure 2:
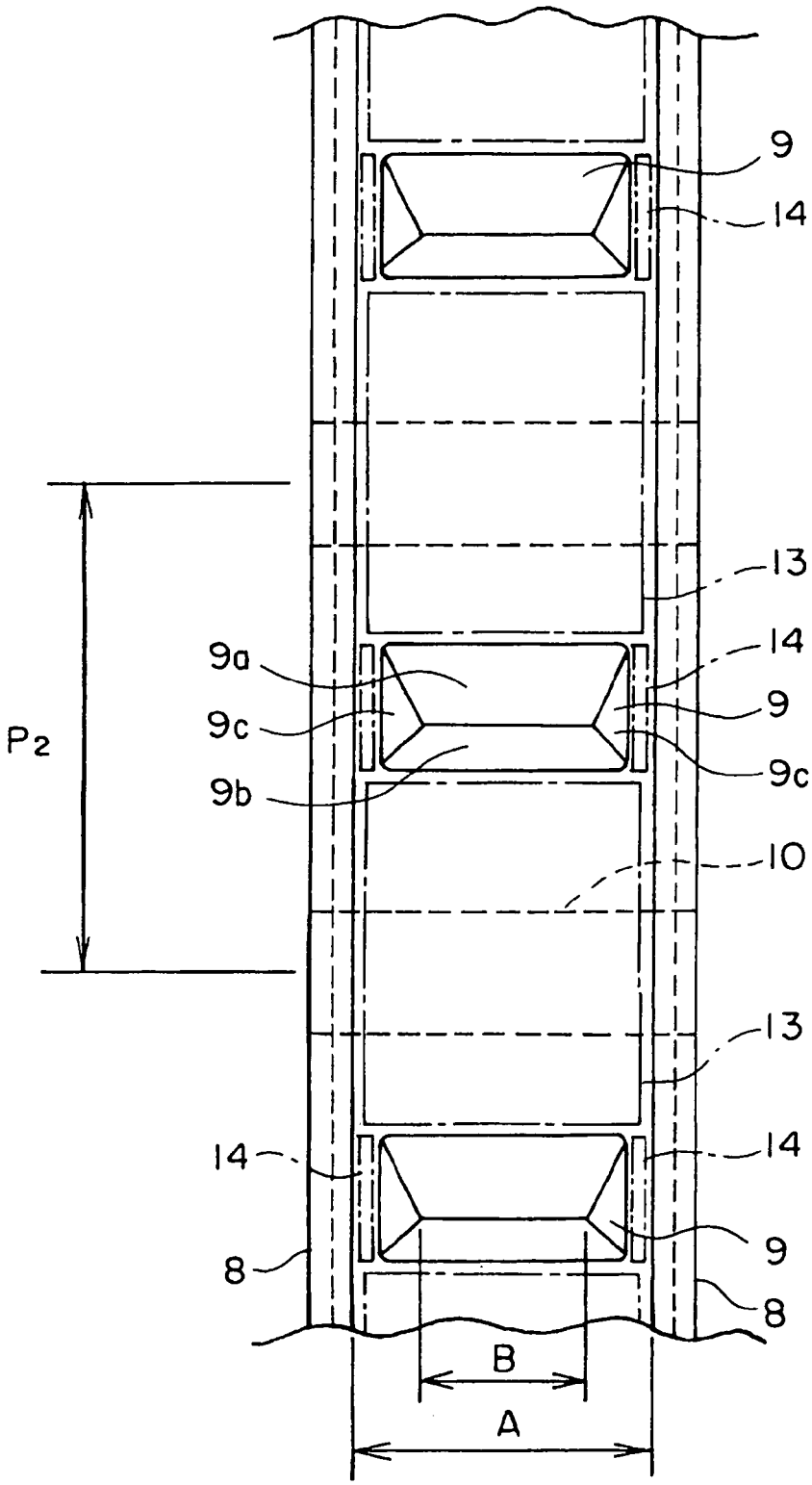
FIG. 2 is a partial front view showing the ice making plate used in an embodiment of the present invention.

As shown in FIG. 2, a plurality of ice making regions 13, which are substantially rectangular and produce ice near the cooling tube 10, are defined at vertical intervals between the adjacent vertical ribs 8. The projecting portions 9 are arranged between adjacent ice making regions 13 in the vertical direction in order to prevent each nugget of ice from connecting to each other in the vertical direction. It is to be noted that the widths of the ice making regions 13 actually agree with the interval A between adjacent vertical ribs 8 since the widths of the ice making regions 13 are defined by the adjacent vertical ribs 8, although, for the sake of convenience, the width of the ice making regions 13 are shown to be narrower than the interval A in illustrating the ice making regions 13. That is, the ice making regions 13 have a width A.

Each projecting portion 9 located between the adjacent ice making regions 13 has a width B smaller than the width A of the ice making regions 13. Accordingly, a portion where no projecting portion 9 is formed, in other words, non-projecting portions 14 are defined at both sides of the projecting portion 9 between the adjacent ice making regions 13 in the vertical direction. The non-projecting portion 14 is defined so as to be flush with the surface of the ice making plate 7, and the adjacent ice making regions 13 are made to connect to each other in the vertical direction.

Figure 3:
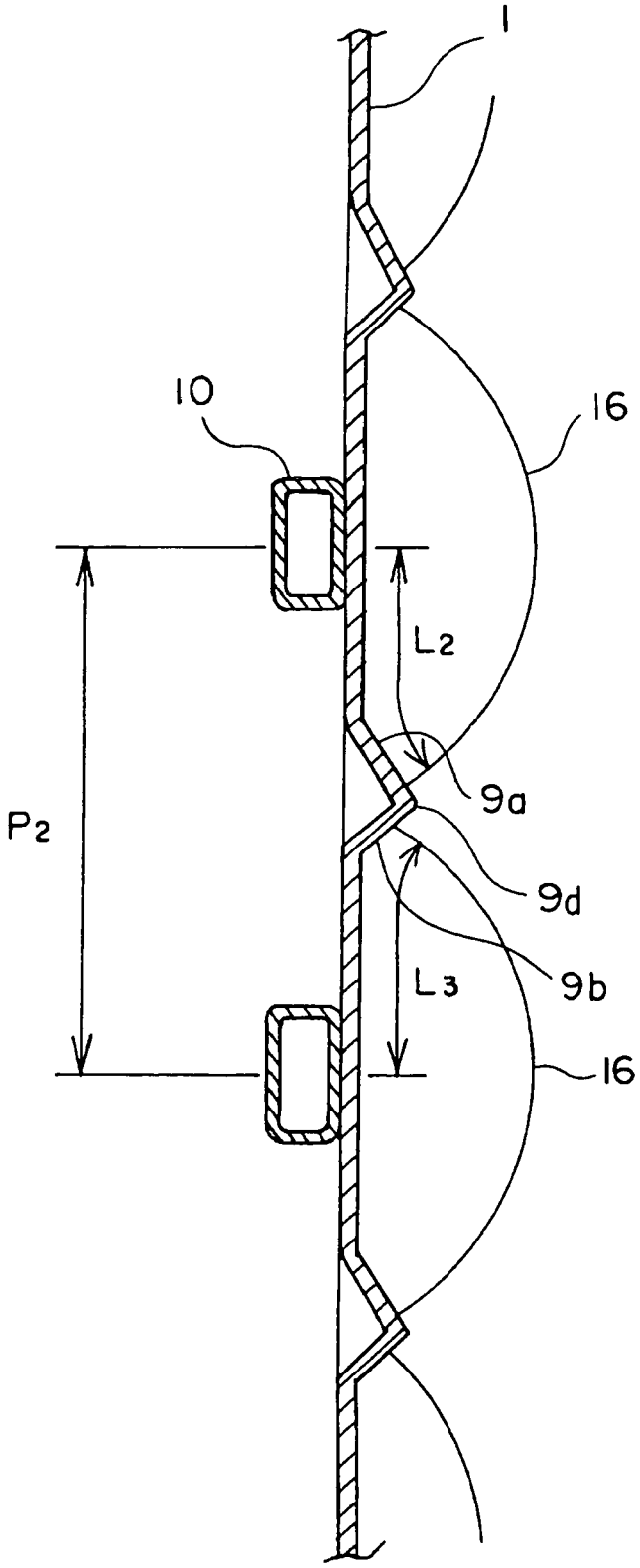
FIG. 3 is a partial longitudinal sectional view showing the ice making plate used in an embodiment of the present invention.
Figure 4:
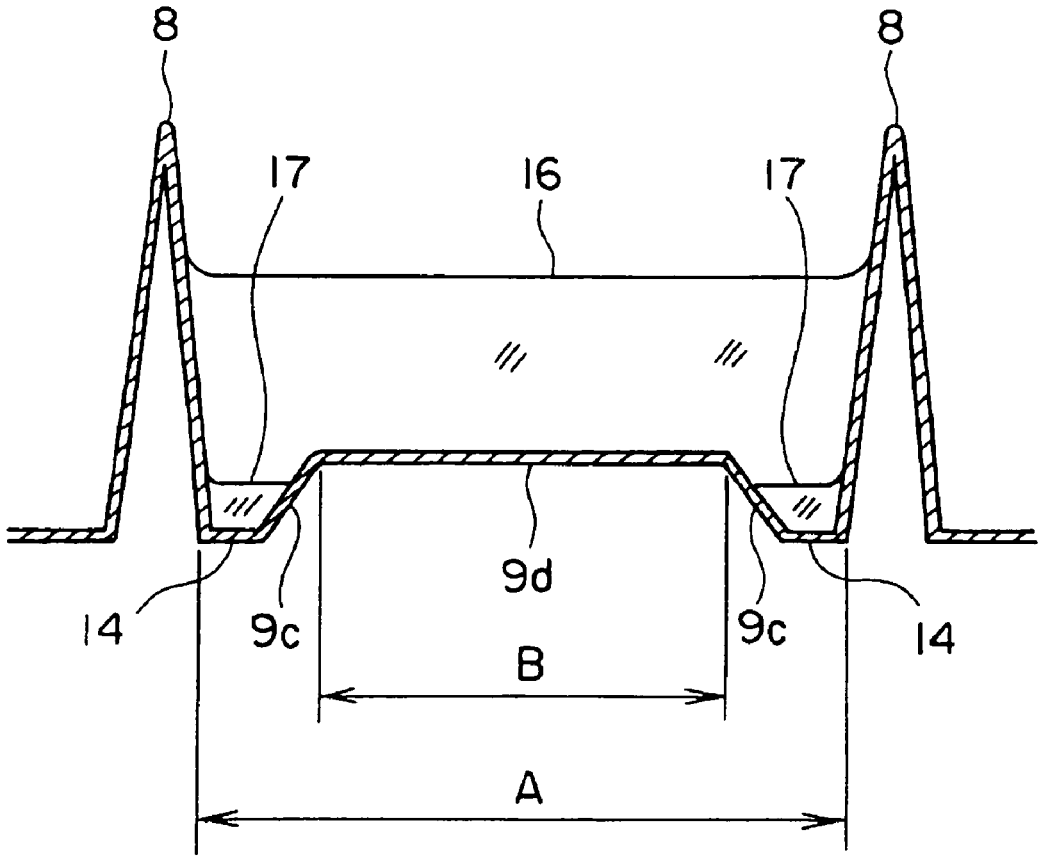
FIG. 4 is a partial cross sectional view showing the ice making plate used in an embodiment of the present invention.

Further, each projecting portion 9 includes a trapezoidal upper surface portion 9*a*, a trapezoidal lower surface portion 9*b*, and triangular side surface portions 9*c*. As shown in FIG. 3, the upper surface portion 9*a* and the lower surface portion 9*b* protrude through the surface of the ice making plate 1, and the connecting portion thereof forms an apex 9*d* of the projecting portion 9. Further, as shown in FIG. 4, each side surface portion 9*c* of the projecting portion 9 has a slant extending toward the center of the projecting portion 9 i.e., from the non-projecting portion 14 to the apex 9*d*.

Figure 5:
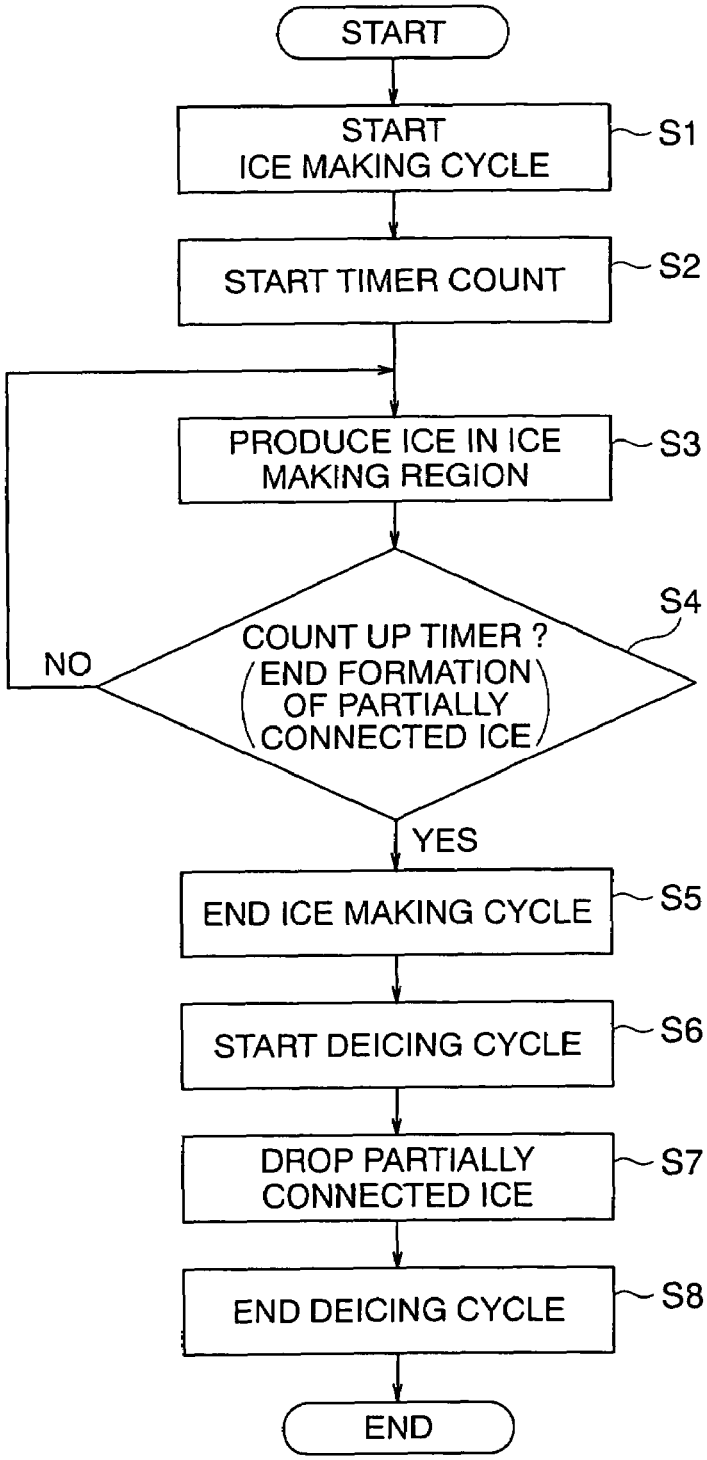
FIG. 5 is a flowchart illustrating the ice making method according to an embodiment of the present invention.

Next, an ice making method for a vertical ice making machine according to this embodiment is described with reference to the flowchart shown in FIG. 5.

First, in Step S1, the ice making cycle for producing ice on the surface of the ice making plate 7 of the vertical ice making machine is started. Then, in Step S2, the timer starts counting, low-temperature refrigerant flows into the cooling tube 10, and ice making water is distributed from the ice making water distributor 4 so as to flow down on the front surface of the ice making plate 1. In Step S3, the ice making water flowing down between adjacent vertical ribs 8 gradually freezes into ice in each ice making region 13 defined near the cooling tube 10, and ice nuggets are formed. In Step S4, the ice nuggets are made to grow by repeating Step S3 until the timer is counted up. After the timer is counted up in Step S4, the process goes to Step S5 where the distribution of ice making water to the surface of the ice making plate 7 and the supply of the low-temperature refrigerant to the cooling tube 10 are suspended respectively, thereby ending the ice making cycle.

Figure 6:
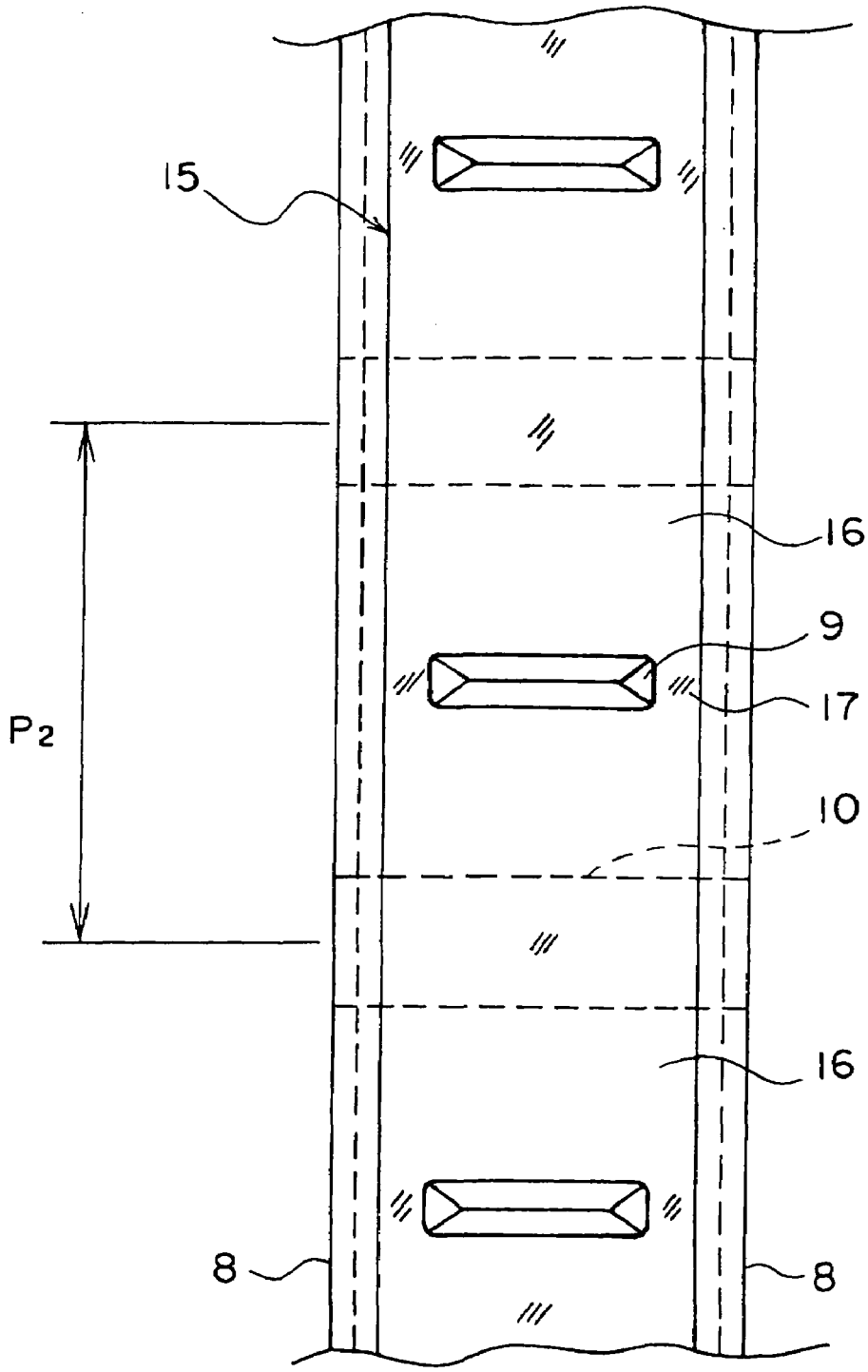
FIG. 6 is a partial front view showing how ice is formed on the ice making plate used in an embodiment of the present invention.

During the ice making cycle, partially connected ice 15 as shown in FIG. 6 is formed between the adjacent vertical ribs 8 on the surface of the ice making plate 7. The partially connected ice 15 is formed by ice nugget portions 16 grown in adjacent ice making regions 13 in the vertical direction as shown in FIG. 3 which have partially connected to each other by connecting ice nugget portions 17 formed on the non-projecting portions 14 at both sides of the projecting portions 9 as shown in FIG. 4.

Most of the growth of each ice nugget portion 16 in the vertical direction is restricted by the upper surface portion 9*a* and lower surface portion 9*b* of the projecting portion 9, and the ice nugget portion 16 is prevented from connecting to other ice nugget portions 16 formed in other ice making regions 13. However, apart of the ice nugget portions 16 grow beyond the ice making regions 13 so as to reach the non-projecting portion 14 defined on either side of the projecting portion 9, and the ice nugget portions 16 connect to other ice nugget portions 16 grown likewise in other ice making regions 13. In this way, the timer count is set in advance based on experimental data etc., such that the ice continues to grow until the ice nugget portions 16 grow enough to form the partially connected ice 15. Accordingly, the partially connected ice 15 which has been formed can be obtained when the timer is counted up.

Next, in Step S6, a deicing cycle for separating the partially connected ice 15 from the ice making plate 7 is started. During the deicing cycle, high-temperature refrigerant flows into the cooling tube 10, and deicing water is distributed from the deicing water distributor 12 so as to flow down on the back surface of the ice making plate 1. As a result, each ice nugget portion 16 and each connecting portion 17 for connecting the ice nugget portions melt at the contact portion with the surface of the ice making plate 7, and the partially connected ice 15 consisting of the ice nugget portions 16 and the connecting portions 17 slides downward by its own weight. As shown in FIG. 3, a part of each ice nugget portion 16 is formed on the upper surface portion 9*a* of the projecting portion 9, and this portion slides downward on the upper surface portion 9*a*, whereby each ice nugget portion 16 separates from the ice making plate 7 so as to fall. In this way, in Step S7, the partially connected ice 15 falls from the ice making plate 7, and the deicing cycle ends in Step S8.

Since a plurality of ice nugget portions 16 formed so as to align in the vertical direction between the adjacent vertical ribs 8 are formed as the partially connected ice 15 connected integrally by each connecting portion 17 for connecting ice nugget portions, the partially connected ice 15 falls as an integrated whole. At this time, since the falling of the whole partially connected ice 15 is facilitated by the continuous melting of the ice nugget portions 16 at the contact portions with the ice making plate 7 in the ice making regions 13, the time required for dropping all the ice nugget portions 16 is reduced as compared with the case where a plurality of ice nugget portions 16 are formed individually without being connected to each other by the connecting portions 17.

In this way, the partially connected ice 15 separated from the surface of the ice making plate 7 falls into an ice storage bin (not shown) provided at a lower position. However, since the connections between ice nugget portions 16 are only partial, the connecting portions 17 used for the connection are smaller than the ice nugget portions 16. Thus, the connecting portions 17 are broken by the impact of the fall such that each ice nugget portion 16 separates.

As described above, since the ice nugget portions 16 are connected by the connecting portions 17 so as to form the partially connected ice 15, the falling can be facilitated during the deicing, and the amount of melting ice at this time can be decreased, whereby the daily capacity for producing ice can be improved. Moreover, since the time required for deicing is shortened, the deicing water usage can be decreased.

Further, since the partially connected ice 15 is formed, the whole surface of the ice making plate 7 can be substantially used for ice making as compared with the case where ice is formed individually at regular intervals so that there are no connections, whereby the amount of ice production per unit of surface area of the ice making plate 7 can be increased.

Further, as shown in FIG. 3, since each ice nugget portion 16 is allowed to grow until its edge face reaches the vicinity of the apex portion 9*d* defined by the upper surface portion 9*a* and lower surface portion 9*b* of the projecting portion 9 in order to form the connecting portion 17 for connecting ice nugget portions, distances $L_2$ and $L_3$ (see FIG. 3) from the cooling tube 10 to the edge face of the ice nugget portion 16 can be made at least equal or longer than those of the prior art as compared with the case where, as in the prior art, ice is formed individually at regular intervals so that they do not connect, even if a pitch $P_2$ of the cooling tube 10 is reduced. Therefore, the amount of ice production per unit of surface area of the ice making plate 7 can be increased.

Figure 7:
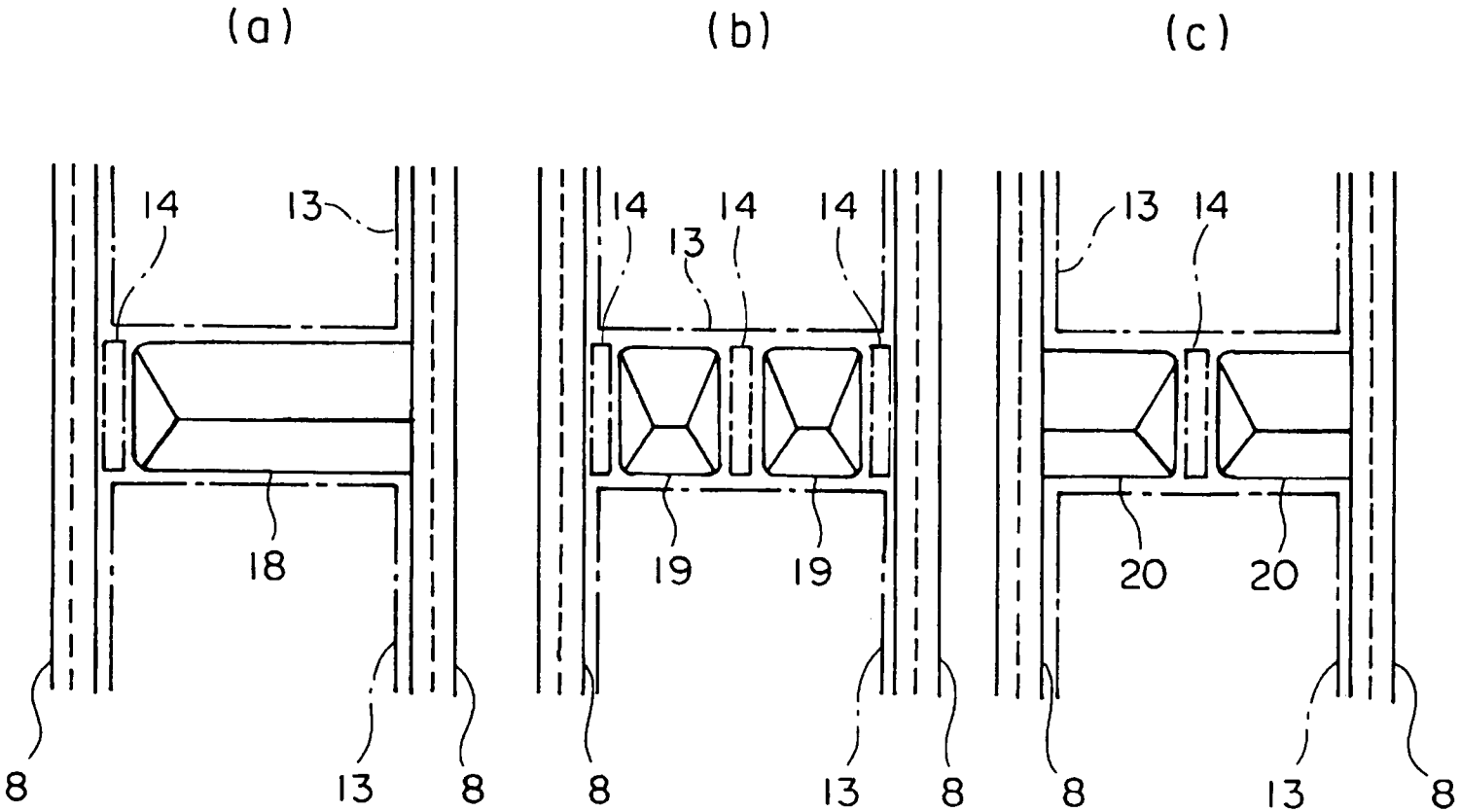
FIGS. 7A, 7B, and 7C are partial front views showing modifications of a projecting portion used in an embodiment of the present invention.
Figure 8:
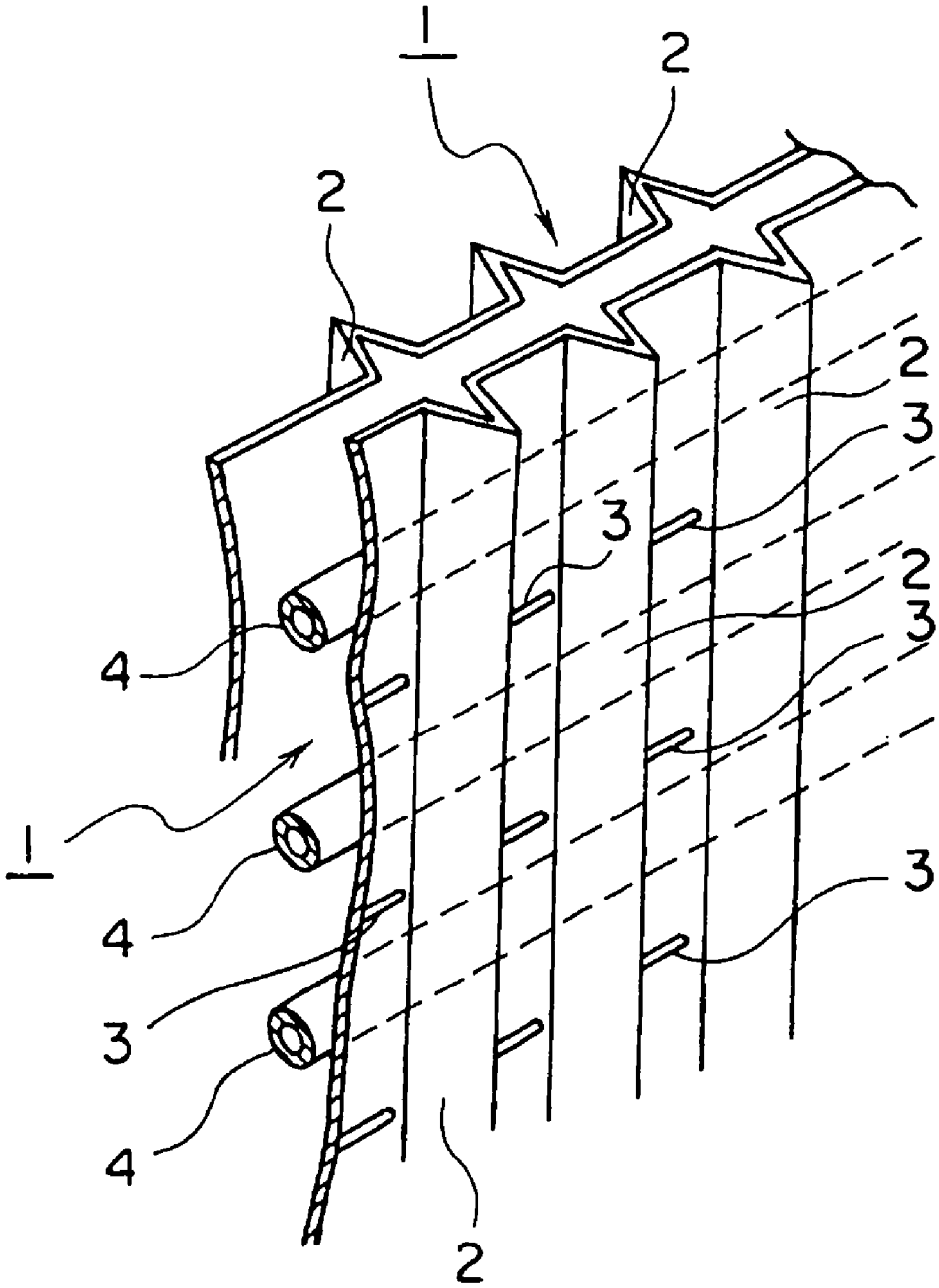
FIG. 8 is a perspective view showing an ice making plate of a conventional vertical ice making machine.
Figure 9:
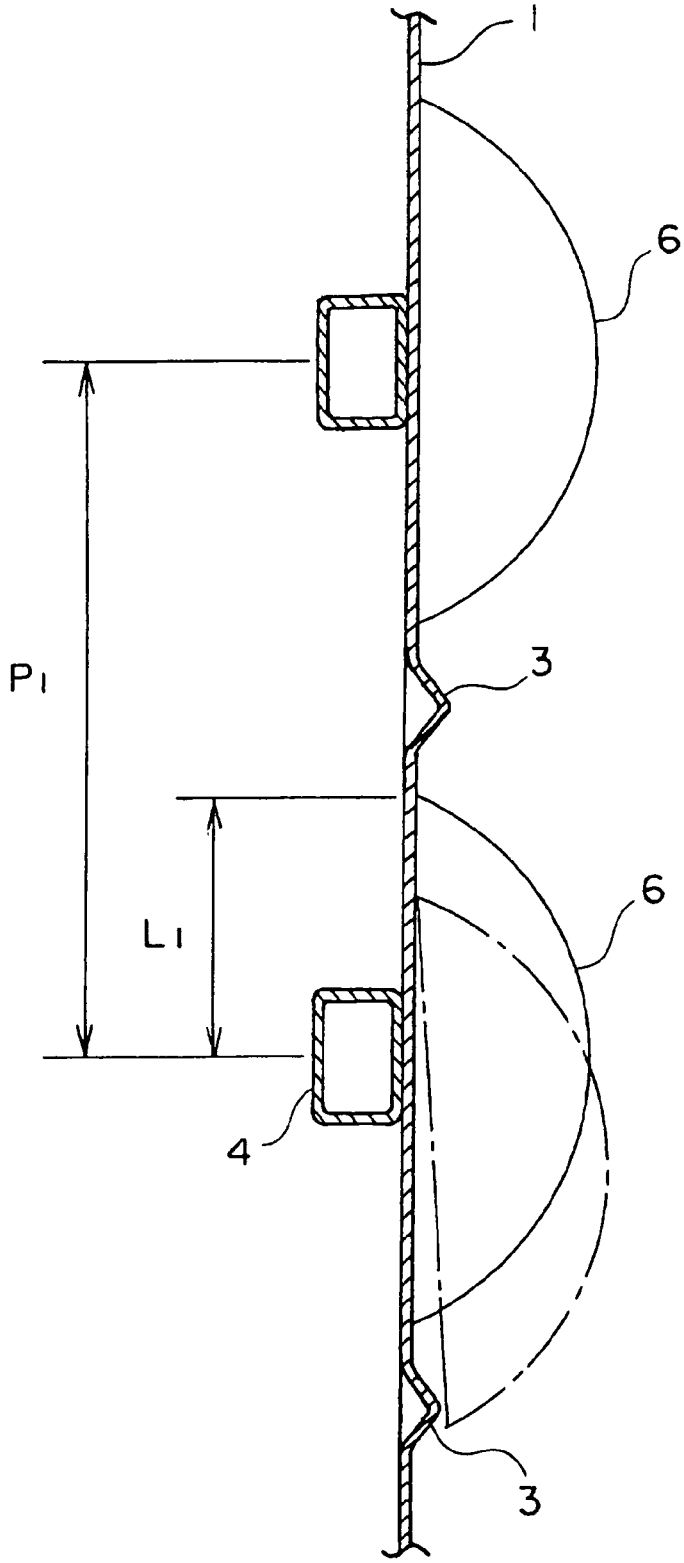
FIG. 9 is a partial sectional view showing the ice making plate of the conventional vertical ice making machine.

It is to be noted that the configurations of the projecting portion 9 and the non-projecting portion 14 are not limited to those described above. As shown in FIG. 7A, one side portion of a projecting portion 18 may be integrally formed with one vertical rib 8, and the non-projecting portion 14 may be defined only on the other side portion of the projecting portion 18. Also, as shown in FIG. 7B, a plurality of projecting portions 19 may be arranged in the lateral direction so as to define the non-projecting portion 14 on either side portion of each projecting portion 19. Further, as shown in FIG. 7C, two projecting portions 20 in which one side portion is integrally formed with one vertical rib 8 may be arranged side by side, and the non-projecting portion 14 may be defined in the other side portion of each projecting portion 20, that is, between the two projecting portions 20. In other words, any projecting portion suffices as long as it has a width B smaller than the width A of the ice making region 13 and the non-projecting portion 14 that serves to connect the adjacent ice making regions 13 to each other in the vertical direction is defined.

What is claimed is:

1. A method of making ice in a vertical ice making machine, the method comprising:

forming ice at a plurality of ice making regions on an ice making plate, said ice making regions being arranged vertically on said ice making plate, partially preventing the formation of ice between said ice making regions by providing said ice making plate with at least one tapered projecting portion between vertically adjacent ice making regions, said at least one tapered projecting portion having a lateral width that is smaller than a lateral width of said ice making regions such that at least one non-projecting area is provided on said ice making plate between said vertically adjacent ice making regions;

forming ice at said at least one non-projecting area on said ice making plate, said ice formed at said at least one non-projecting area connecting said ice formed at said vertically adjacent ice making regions thereby forming an integrated ice formation; and, dropping said integrated ice formation from said ice making plate.

2. The method according to claim 1, wherein said forming ice at said at least one non-projecting area includes forming ice at a first non-projecting area and a second non-projecting area, said first non-projecting area being provided adjacent a first end of said at least one projecting portion and said second non-projecting area being provided adjacent a second end of said at least one projecting portion, said ice formed at said first and second non-projecting areas connecting said ice formed at said vertically adjacent ice making regions thereby forming said integrated ice formation.

3. The method according to claim 1, wherein said providing said ice making plate with at least one tapered projecting portion includes providing said ice making plate with a first tapered projecting portion and a second tapered projecting portion, and said non-projecting area being provided on said ice making plate between said vertically adjacent ice making regions includes said non-projecting area being provided between said first tapered projecting portion and said second tapered projecting portion.

4. The method according to claim 1, wherein said providing said ice making plate with at least one tapered projecting portion includes providing said at least one tapered portion with a trapezoidal upper surface portion, a trapezoidal lower surface portion, and triangular side surface portions and said dropping said integrated ice formation from said ice making plate includes sliding said integrated ice formation downward on said trapezoidal upper surface portion of said at least one tapered projection portion.

* * * * *